US008616374B2

(12) United States Patent
Hemmerlin

(10) Patent No.: US 8,616,374 B2
(45) Date of Patent: Dec. 31, 2013

(54) POUCH HAVING TEAR STRIP

(75) Inventor: David Hemmerlin, Basel (CH)

(73) Assignee: Novartis AG, Basel (CH)

( * ) Notice: Subject to any disclaimer, the term of this patent is extended or adjusted under 35 U.S.C. 154(b) by 52 days.

(21) Appl. No.: 13/058,707

(22) PCT Filed: Sep. 1, 2009

(86) PCT No.: PCT/EP2009/061292
§ 371 (c)(1),
(2), (4) Date: Feb. 11, 2011

(87) PCT Pub. No.: WO2010/026142
PCT Pub. Date: Mar. 11, 2010

(65) Prior Publication Data

US 2011/0139784 A1 Jun. 16, 2011

(30) Foreign Application Priority Data

Sep. 3, 2008 (EP) ..... 08163619

(51) Int. Cl.
*B65D 75/26* (2006.01)
*A61B 17/08* (2006.01)
*B65D 33/00* (2006.01)
*B65D 33/16* (2006.01)

(52) U.S. Cl.
USPC ..... 206/484; 206/440; 383/204; 383/207; 383/209

(58) Field of Classification Search
USPC ..... 206/469, 484–484.2, 438, 440, 441; 383/66, 204, 205, 207, 209, 200
See application file for complete search history.

(56) References Cited

U.S. PATENT DOCUMENTS 3,012,894 A * 12/1961 Nagel ..... 206/484
3,186,628 A * 6/1965 Rohde ..... 383/209
4,131,195 A * 12/1978 Worrell, Sr. ..... 206/484
4,335,817 A * 6/1982 Bahr ..... 383/204

(Continued)

FOREIGN PATENT DOCUMENTS

CA 2373280 A1 11/2001
CN 101014505 A 8/2007

(Continued)

OTHER PUBLICATIONS

International Search Report, PCT/EP2009/061292 (Dec. 4, 2009).

*Primary Examiner* — Bryon Gehman
(74) *Attorney, Agent, or Firm* — Michael J. Mazza

(57) ABSTRACT

A pouch for containing a product, the pouch comprising a first wall (6) and a second wall (8), the first wall and second wall being sealed together in sealed regions (10), the sealed regions substantially surrounding a compartment (12) including a product portion within which a product (2) can be located, the first wall (6) comprising a tear strip (16) extending towards at least a part of the compartment, the tear strip (16) including a tab portion (18) at a proximal end, the tab portion (18) is separated from the compartment region (12) by a sealed region and is located away from edges of the pouch, the tear strip having tear guiding regions (24, 26) in the first wall (6) at first and second opposing edges, the pouch being arranged such that the tab portion (18) can be grasped and a removal force exerted thereon to cause a tear to extend along each of the tear guiding regions (24, 26) so that at least a portion of the tear strip (16) is torn away from the pouch to render the compartment (12) accessible.

12 Claims, 5 Drawing Sheets

(56) References Cited

U.S. PATENT DOCUMENTS

| | | | | | |
|---|---|---|---|---|---|
| 4,549,658 | A * | 10/1985 | Sfikas | 206/469 |
| 4,775,094 | A * | 10/1988 | Eisele | 383/66 |
| 4,781,294 | A * | 11/1988 | Croce | 206/469 |
| 4,834,245 | A | 5/1989 | Ohga | |
| 4,923,063 | A * | 5/1990 | Tararuj | 206/484 |
| 5,464,285 | A * | 11/1995 | Anderson | 383/207 |
| 5,588,239 | A * | 12/1996 | Anderson | 40/310 |
| 5,613,779 | A | 3/1997 | Niwa | |
| 6,698,928 | B2 * | 3/2004 | Miller | 383/205 |
| 6,889,483 | B2 * | 5/2005 | Compton et al. | 53/412 |
| 6,974,032 | B2 * | 12/2005 | Intini | 206/532 |
| 7,021,827 | B2 * | 4/2006 | Compton et al. | 383/205 |
| 7,770,726 | B2 * | 8/2010 | Murray et al. | 206/438 |
| 7,921,999 | B1 * | 4/2011 | Kimball | 206/440 |
| 8,051,983 | B2 * | 11/2011 | Simon et al. | 206/484 |
| 2005/0077203 | A1 | 4/2005 | Morita et al. | |
| 2006/0023976 | A1 | 2/2006 | Alvater | |
| 2008/0023532 | A1 * | 1/2008 | Moresi | 229/92.8 |
| 2008/0105582 | A1 | 5/2008 | Ludwig | |
| 2008/0152264 | A1 | 6/2008 | Pokusa | |
| 2009/0190867 | A1 | 7/2009 | Goto et al. | |

FOREIGN PATENT DOCUMENTS

| | | | |
|---|---|---|---|
| EP | 0471220 | | 2/1992 |
| EP | 0849071 | A2 | 6/1998 |
| FR | 1435966 | A | 4/1966 |
| GB | 1350886 | | 4/1974 |
| GB | 2314553 | A | 1/1998 |
| JP | 9207948 | A | 8/1997 |
| JP | 2003501321 | A | 1/2003 |
| JP | 2004292021 | A | 10/2004 |
| JP | 2004299728 | A | 10/2004 |
| WO | 2007021439 | A2 | 2/2007 |

* cited by examiner

POUCH HAVING TEAR STRIP

This application is a 35 USC §371 application of International Application No. PCT/EP2009/061292 filed Sep. 1, 2009, designating the United States, which claims priority to EP Application No. 08163619.3 filed Sep. 3, 2008, and which is hereby incorporated by reference in its entirety.

The present invention relates to a pouch, in particular to a pouch for packaging a medicament product such as a patch, particularly a patch for transdermal delivery of a medicament.

Many products are supplied in pouches which protect the product from the ambient atmosphere and/or help to prevent unwanted access to the product. A pouch might comprise a first wall and a second wall which are joined together in sealed regions. The sealed regions substantially surround a compartment portion within which the product can be located.

Pouches can be difficult to open they must be made durable enough to protect the product during transportation and, in some circumstances, hinder child access to particular products, in particular medicinal products. They can also provide some degree of environmental protection from, for example, moisture.

There are many ways in which pouches can be manually opened. A sealed region along one edge of the pouch could be unsealed by exerting a separation force on the first and second walls such that the sealed region is pealed apart. Another way is for a user to tear the pouch along a line which crosses the compartment and results in the substantial removal of a sealed region from one edge of the pouch.

According to the invention there is provided a pouch for containing a product, the pouch comprising a first wall and a second wall, the first wall and second wall being joined together in sealed regions, the sealed regions substantially surrounding a compartment including a product portion within which a product can be located, the first wall comprising a tear strip extending across at least a part of the compartment, the tear strip including a tab portion at a proximal end, the tab portion being located away from edges of the pouch and there being a sealed portion between the tab and the compartment, the tear strip including tear guiding regions in the first wall at first and second opposing edges, the pouch being arranged such that the tab portion can be grasped and a removal force exerted thereon to cause a tear to extend along each of the tear guiding regions and across at least part of the compartment so that at least a portion of the tear strip is torn away from the pouch to render the compartment accessible.

Providing a pouch with a tab formed in the first wall which, when grasped and pulled, causes tears to extend along two tear guiding regions and across at least a part the compartment portion provides a user with a novel way to access the contents of the pouch.

The tear guiding regions may extend along substantially the entire length of the tear strip, or may extend along only a portion of the length so that any tear initiated from the tab propagates along the tear guides and is then likely to extend further along that path through the, or each, wall. In embodiments in which the tear guiding regions do not extend the full length of the tear strip it should be understood that the tear strip includes the region between the tab and tear guides together with the strip that is to be torn away from the pouch by a user exerting a removal force on the tab.

The tab is arranged so that there is a sealed region between the tab and the compartment so that any weaknesses that define the tab itself do not risk significantly compromising any environmental protection that the compartment provides for a product therein. The tab may be formed within a sealed region outside the compartment, or may be formed in an unsealed region. Preferably there is no path between the tab and the compartment that does not pass through a sealed portion.

The tear guiding regions may extend across at least a part of the compartment portion as this reduces the likelihood of a failed opening in which a user exerting a force on the tab does not create a tear that extends across at least a part of the compartment. The tear guiding regions preferably extend from the tab portion towards, and possibly across, at least part or the compartment portion.

The tab may comprise portions of the first wall only, or portions of both the first and second walls. If the tab comprises portions of both the first and second walls then at least some of the first and second walls in the tab may be sealed together. Grasping and pulling the tab causes tears to extend along the tear guiding regions in the first wall and may also cause tears to extend along substantially corresponding tear guiding regions in the second wall. The tab may comprise portions of one or both walls. If the tab comprises portions of both walls the tear strip may comprise portions of one or both walls. The tab may be defined by a single weakness, such as a cut, perforated line, etched or scored line which extends between the two tear guiding regions.

The tab is formed in at least the first wall and is graspable by a user. At least some of the periphery of the tab may be cut in one, or both, of the walls so that the tab is readily accessible to be grasped. In a different embodiment at least some of the periphery of the tab may include one or more breakable bridges in one or both walls that connect the tab to the surrounding wall. The breakable portions may retain, the tab so that a user is hindered from grasping it until the user has broken the breakable bridges. The breakable bridges can help to increase the level of child resistance, while the tab, one accessible facilitates access to a product contained in the compartment. Substantially the entire periphery of the tab not connected to the remainder of the tear strip may comprise a breakable bridge formed by, for example mechanical or laser scoring of the first wall.

If the tab comprises portions of they first wall only the first and second walls may not be sealed to one another in at least some, and maybe substantially the entire tab region.

The tear strip that is torn away from the pouch may provide an access strip through which a user can gain access to the product portion, or may substantially open the product portion. The tear strip that is torn away from the pouch may remain attached thereto at an end, or may be completely removed. The tear strip may extend across a portion of the compartment only and not the product portion. The tear strip may extend across portions of both the product portion and compartment and may extend across substantially the entire product portion.

In one embodiment, the tab comprises portions of both the first and second walls and grasping and palling the tab causes tears to extend along tear guiding regions in both the first wall and second wall and the tear strip torn away from the pouch includes the product portion of the compartment such that the product is accessible from one or both sides of the tear strip.

The pouch may contain a medicament product in the form of a patch, particularly a medicated patch for transdermal delivery of a medication. In a different embodiment the pouch may contain a powder product, a tablet product, or any other product. In all these cases the product may or may not be medicated.

The pouch may further include a flap. The flap may be formed along one edge thereof. A suitable flap can be formed by folding a fold portion of the pouch and releasably securing it to a wall such that the flap substantially covers the tab and hinders access to the tab. The releasable securing may be by peelably sealing. Alternatively, the flap may be formed by a separate piece of material, which may be the same as the wall material, may be a laminate, may be a paper material or other suitable material. The separate flap is releasably secured to a wall such that the tab is substantially covered, or that access to said tab is hindered.

Such a flap can be used to add an additional step for pouch opening for a variety of different pouch embodiments and the present invention therefore further provides a pouch for containing a product, the pouch comprising a first wall and a second wall, the first wall and second wall being sealed together in sealed regions, the sealed regions substantially surrounding a compartment including a product portion within which a product can be located, the pouch including at least one preformed opening feature from which a user can initiate a tear and thereby gain access to the product portion of the compartment, the pouch further including at least one flap which releasably secured to one side of the pouch such that the flap substantially covers the preformed opening feature.

Such an arrangement of the flap hinders access to the preformed opening feature and a user must then perform a two step action in order to open the pouch, first unfolding or removing the flap sufficiently to gain access to the preformed opening feature, and then tearing the pouch starting at said feature. The preformed opening feature may be a tab as described above, may be a notch in an edge, or through a portion of the pouch, or may be any other sort of features, for example a weakness from which a tear may be initiated. It should be noted that the flap may only substantially cover the preformed opening feature from one side of the pouch, but such a cover will still hinder access to the opening feature.

As noted above, a flap can be formed using at least a portion of one or both of the walls, folded over and releasably secured onto a wall. Alternatively a flap can be formed from a separate piece of material which is then releasably secured to a wall.

There may be more than one flap, for example two flaps, and the flaps can be releasably secured to either the first wall or second wall. Such flaps could be formed in the same way, or formed in different ways, for example one being a folded flap and the other a separate material flap.

In one embodiment two flaps are provided, one formed from each of the first and second walls and each folded back onto the wall from which they are formed. This creates a three step opening action where a user must unfold both flaps in order to have unhindered access to the pre-formed weakness.

The or each flap may extend along an entire length of an adjacent edge of a pouch or could be shorter that the edge and extend only along the edge in the region of the pre-formed weakness such that when secured onto one of the walls the flap substantially covered, or hindered access to, the preformed opening feature, but that the remainder of the pouch was substantially uncovered. If more than one flap is present the flaps need not be the same length, or in the same position. For example an embodiment of a pouch may include more than one pre-formed weakness and a first flap could hinder access to a first pre-formed weakness, while a second flap could hinder access to a second preformed weakness in a different location, for example an opposite edge of the pouch.

The first and second walls can be fabricated from any suitable material and need not be of the same material. The first and second walls may be fabricated from a flexible film material which may be a laminate or composite material. The film may be a plastics laminate and may include a moisture barrier layer. The first and second walls may be formed from a single piece of material which is appropriately shaped. In such cases it should be understood that the sealed regions need not be between separate free edges of material, but could be a continuous piece of material that, for example folds or curves back on itself so that a piece one side the fold or curve forms part of the first wall and the a piece the other side of the fold forms part of the second wall.

The pouch may be substantially rectangular in shape. However, it should be understood that the pouch could be formed in any suitable shape, for example substantially triangular, substantially circular or an irregular shape if desired. The first and second walls may be fabricated by folding a single strip of film substantially in half. The sealed regions may extend substantially entirely around the periphery of the pouch.

The sealing of the first and second walls together can be achieved in a variety of conventional ways which will not be discussed in detail. Within the compartment portion the first and second walls are not sealed together so the walls and seals cooperate to enclose a volume containing a product portion within which a product such as a medicament patch can be stored. The sealing around the compartment region may be achieved in different ways around the compartment. The first and second walls may be fabricated from a single piece of material which is folded back on itself at least once. The free edges may be sealed, for example by heat sealing, but the folded edge also forms a sealed region and need not be, but can be, further sealed to define the compartment region.

The tear guiding regions may comprise strengthened regions, weakened regions, or simply regions where the relative tear resistance of the wall changes. For example the wall within the tear strip may be strengthened to resist tearing. Tear guiding weaknesses may be formed by any suitable method such as cutting, laser etching, mechanical scoring or perforating. Within the compartment portion the weaknesses may not penetrate entirely through the wall, so appropriate methods include laser etching and mechanical scoring. If the wall is formed from a laminated film the weaknesses may be formed by perforating, cutting or scoring through one or more, but not all layers, of the wall. By avoiding penetrating entirely through the wall the environmental protection of the compartment may not be significantly compromised. It should be understood that the weaknesses need not all be formed by the same method.

It should be understood that throughout this specification and in the claims that follow, unless the context requires otherwise, the word "comprise", or variations such as "comprises" or "comprising", implies the inclusion of the stated integer or step, or group of integers or steps. It should further be noted that features described with reference to one embodiment only are not so limited and may be employed in other embodiments.

The invention will now be further described, by way of example only, with reference to the following drawings in which.

Figure 1:
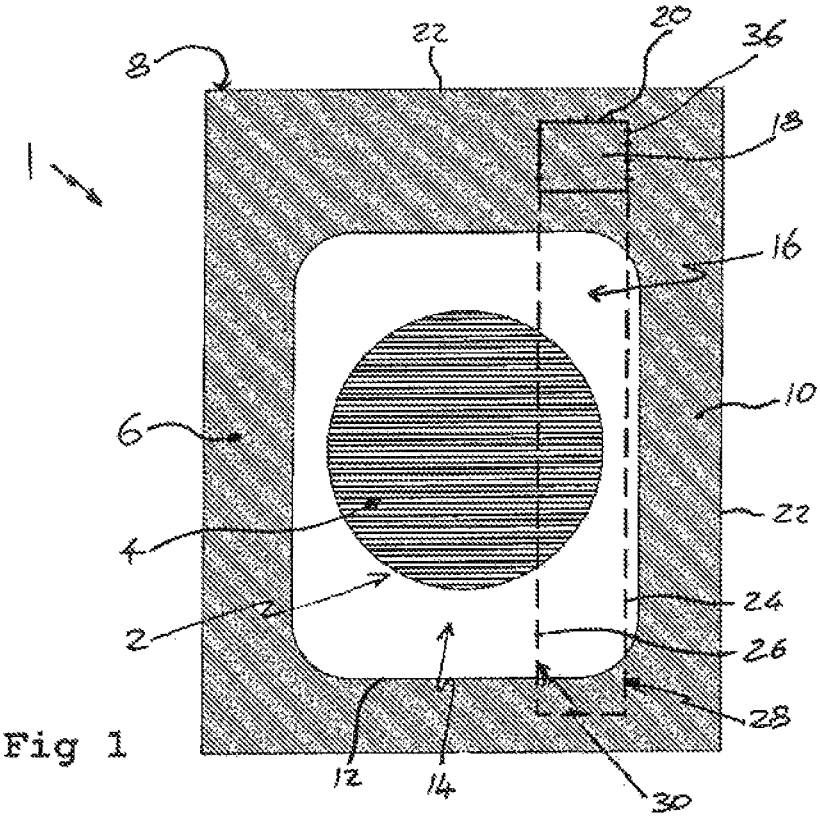
FIG. 1 shows a schematic view of a first embodiment of a pouch.

FIG. 1 shows a schematic view of a pouch 1 for containing a product 2, in this case a medicated patch 4. The pouch 1 comprises a first wall 6 and a second wall 8. The first wall 6 and second wall 8 are sealed together in sealed regions 10. The sealed regions 10 substantially surround a compartment 12 which includes a product portion 14 within which the patch 4 is located.

The first wall 6 comprises a tear strip 16 which extends across at least a part of the compartment 12. The tear strip 16 includes a tab portion 18 at a proximal end 20. The tab portion 18 is located outside the compartment, in this case within a sealed region 10 and away from edges 22 of the pouch 1 such that there is a sealed region between the tab and the compartment. The tear strip 16 has tear guiding regions 24,26 in the first wall at first and second opposing edges 28,30. In this case the tear guiding regions 24,26 extend along substantially the entire length of the tear strip 16, but it should be understood that in this, and other embodiments, the material properties of the first and second walls 6,8 may be appropriate for the tear guiding regions to extend for less than substantially the entire length. If the material of the first and second walls 6,8 tears readily in substantially straight lines it may be sufficient to provide only short tear guiding regions 24,26 to orientate the tears and then allow the tears to extend naturally in the guided direction to open the pouch 1.

Figure 2:
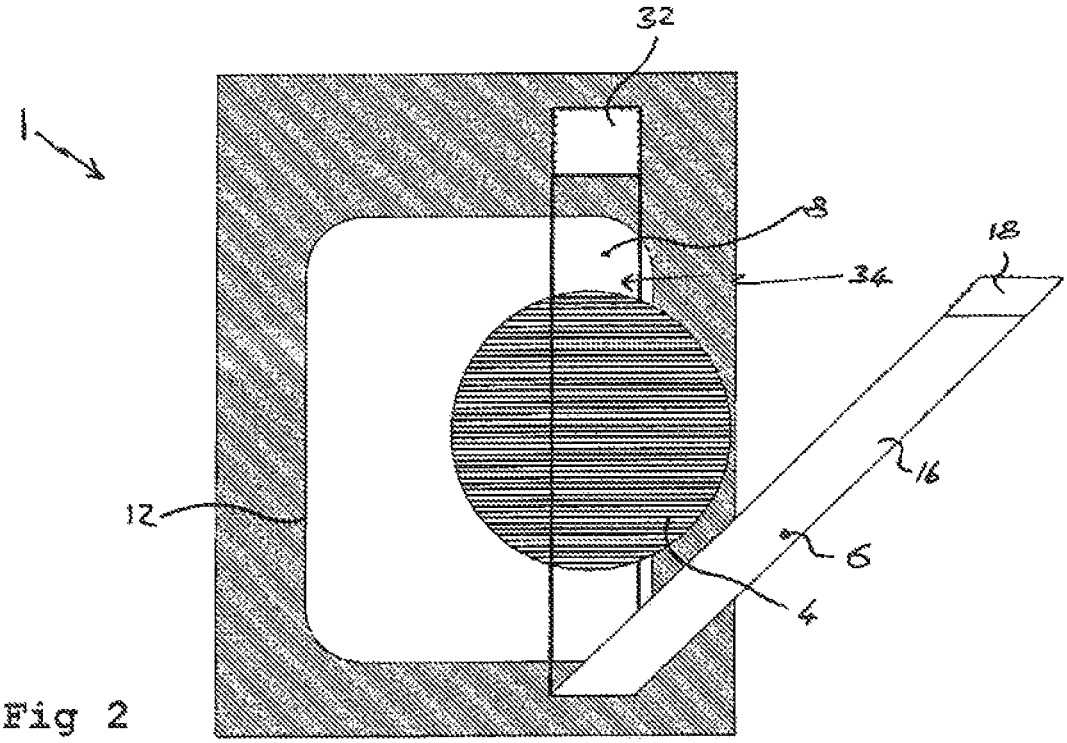
FIG. 2 shows a schematic view of the pouch of FIG. 1 which has been opened.

The poach 1 is arranged such that the tab portion 16 can be grasped and a removal force exerted thereon to cause a tear to extend along each of the tear guiding regions 22,24, in this case tear guiding weaknesses, so that at least a portion of the tear strip 14 is torn away from the pouch 1 to render the compartment 12 accessible as shown in FIG. 2.

FIG. 2 shows an opened pouch 1 of FIG. 1. In this case the tab portion 18 includes a portion of both the first and second wall 6,8 such that when the tab portion is released from the pouch to be grasped an aperture 32 is left in the pouch 1.

The periphery 36 of the tab portion 18 not attached to the remainder of the tear strip 16 is perforated, in this case the perforations extend through both the first and second walls 6,8, but could extend only through the first wall 6, so that there are a plurality of breakable bridges (not shown) which retain the tab portion 18 relative to the first wall 6. The breakable bridges are broken buy a user to release the tab portion 18 to allow a user to grasp the tab portion to apply a removal force pulling the tab portion 18 away from the pouch such that tears extend along the path of the tear guiding regions 24,26.

The tear guiding weaknesses in this case are laser etched lines which do not penetrate through the first wall, but which provide a weakness in the first wall which a tear will preferentially follow. There is also a weakness in the second wall 8 the tab portion 18 and the remainder of the tear strip 16 so that the second wall 8 breaks so that the tab portion 18 is removed from the pouch 1 and the remainder of the tear strip 16 is torn away from tears extending along the tear guiding regions 24,26 and the first wall 6 peeling from the second wall 8 in the sealed regions.

In this embodiment the remainder of the tear strip 16 only includes a portion of the first wall 6 so that an opening 34 through which the patch 4 can be removed is presented through the first wall 6 into the compartment 12 when the tear strip is torn away from the pouch 1. The second wall 8 is visible though the opening 34.

Figure 3:
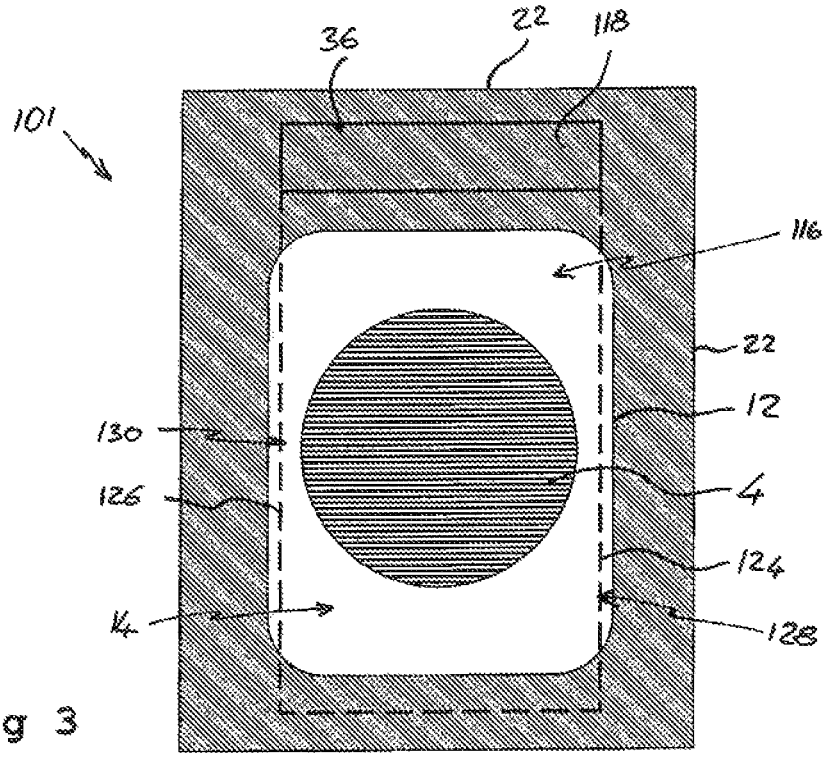
FIG. 3 shows a schematic view of a second embodiment of a pouch.

FIG. 3 shows a schematic view of a second embodiment of a pouch 101. In this case the features that operate in the same way as the embodiment of FIG. 1 will be referenced with the same numerals.

The tear strip 116 of the pouch 101 is wider than that shown in FIG. 1 and in this embodiment the tear strip includes the product region 14 of the compartment 12. The tab portion 118 is again located away from edges 22 of the pouch 101 and retained to the first wall 6 by breakable bridges formed by perforating the periphery 36 of the tab portion 118 not attached to the remainder of the tear strip 116.

The tear guiding regions 124,126 on either side 128,130 of the tear strip 116 are formed in both the first and second walls 6,8. The tear guiding regions in this case are tear guiding weaknesses formed by laser etching.

The tab portion 118 again includes portions of both the first and second walls 6,8.

In use, the breakable bridges at the periphery 36 are broken to give grasping access to the tab portion 118 so a user can grasp the tab portion 118 and apply a removal force thereto. The force on the tab portion 118 causes tears to extend along the tear guiding regions 124,126 in both the first and second walls 6,8 so that the tear strip is torn away from the pouch 101 as shown in FIG. 4.

Figure 4:
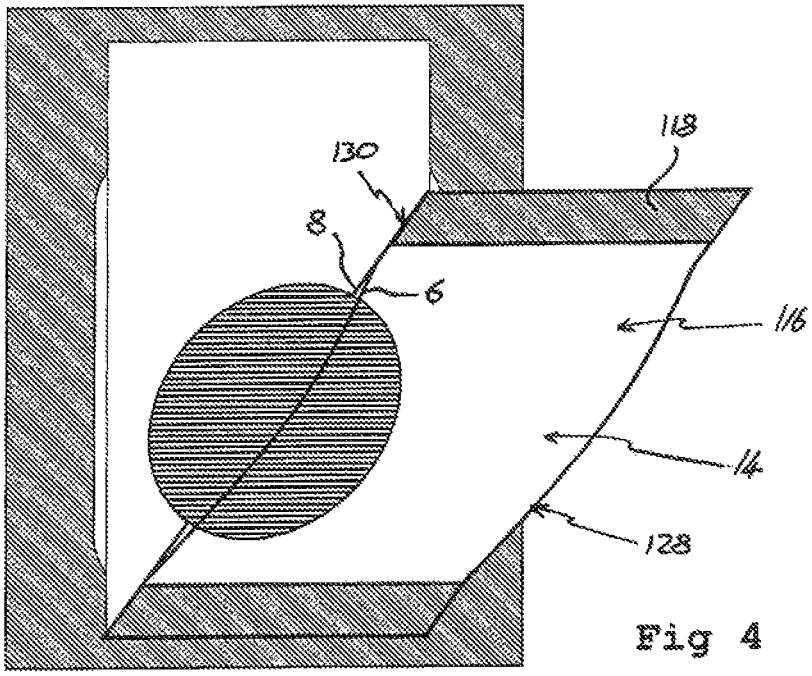
FIG. 4 shows a schematic view of the pouch of FIG. 3 which has been opened.

As shown in FIG. 4 the tear strip 116 includes the product portion 14 of the compartment if so the patch 4 is located in the tear strip 116. To access the patch 4 the first and second walls 6,8 are separated and the patch 4 can be pushed out of either side 128,130 of the tear strip.

Figure 5:
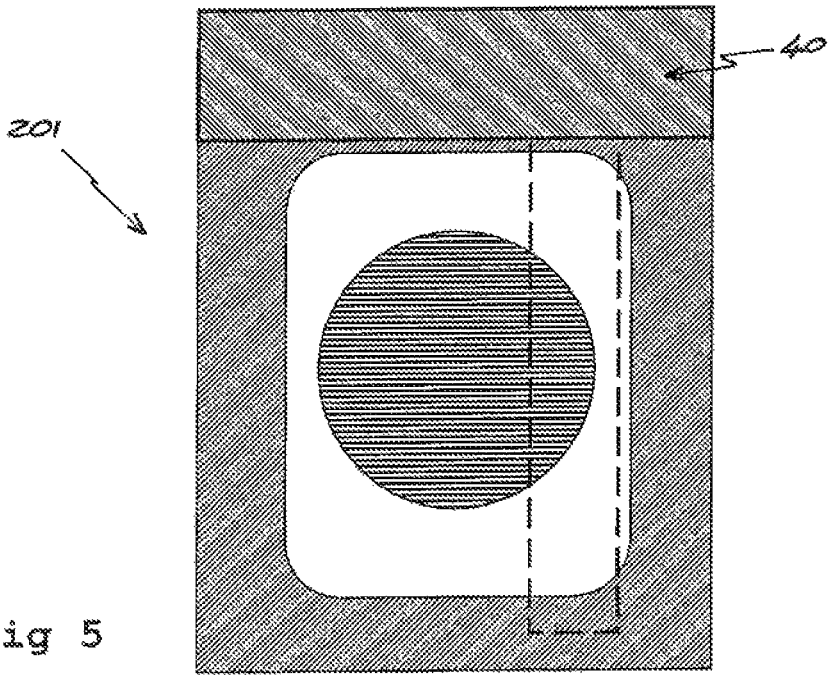
FIG. 5 shows a schematic view of a third embodiment of a pouch which includes a folded portion.
Figure 6:
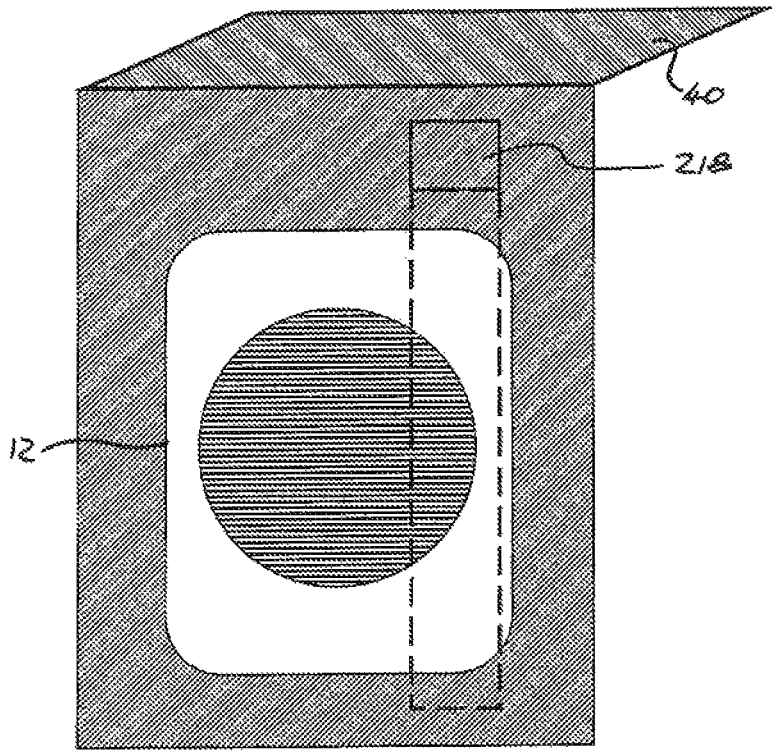
FIG. 6 shows a schematic view of the pouch of FIG. 6 in which the folded portion has been opened.

FIGS. 5 and 6 show a third embodiment of a pouch 201. The pouch 201 is very similar in construction and arrangement to the pouch 1 of FIG. 1, but it includes an additional child resistant feature. The pouch 201 is extended away from the compartment 12 and a flap 40 folded back onto the first wall 6 and peelably secured thereto using conventional techniques such that the flap 40 substantially covers the tab portion 18. The flap 48 prevent direct access to the tab portion from one side of the pouch 201 and helps to prevent the breakable bridges that retain the tab portion 118 from being broken as a user cannot easily press the tab from one side of the pouch 201.

In use, a user would peel the flap 40 away from the pouch to reveal the tab portion 218. The pouch can then be accessed as set forth above.

Figure 7:
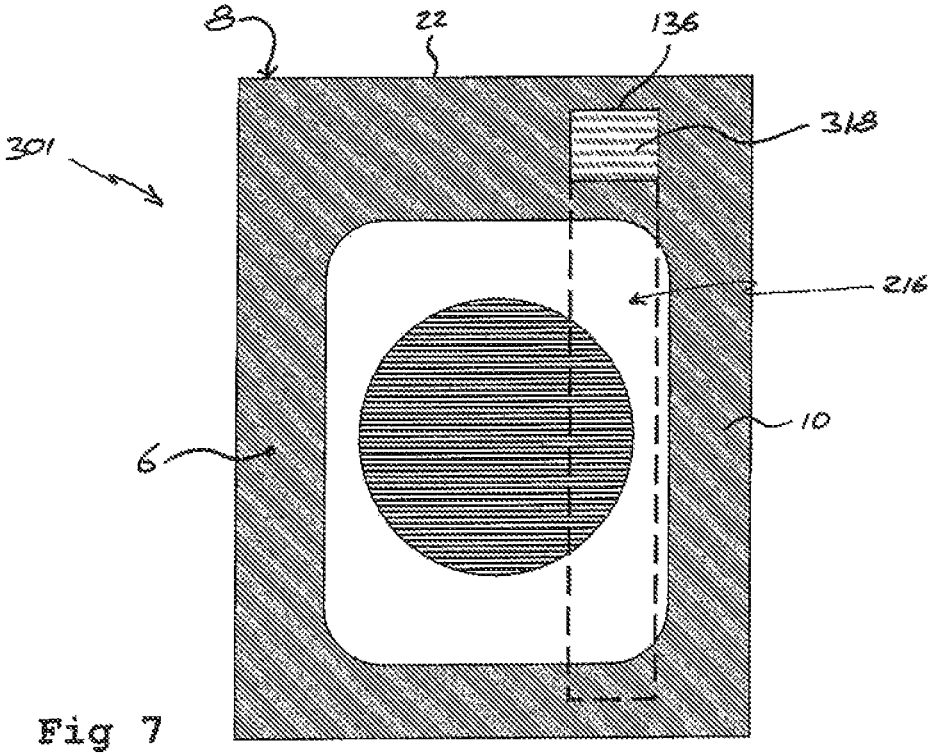
FIG. 7 shows a schematic view of a forth embodiment of a pouch.

FIG. 7 shows a forth embodiment of a pouch 301. Structurally the pouch 301 is very similar to the pouch 1 of FIG. 1 and the same reference numerals will be used where appropriate.

The pouch 301 differs in that in the tab portion 318 the first and second walls 6,8 are not sealed together. The tab portion 318 in this case comprises only the first wall 6 and the periphery 136 is defined by a laser or mechanical etching so that substantially the entire periphery 136 is a breakable bridge, between the tab portion 318 and the first wall 6. In use the breakable bridge is broken by a user by bending the pouch 301 or otherwise and the tab portion 318 becomes available to be grasped by a user as described previously.

The tab portion 318 in this case only comprises the first wall 6 and the tear strip 216 also comprises only the first wall 6.

Figure 8:
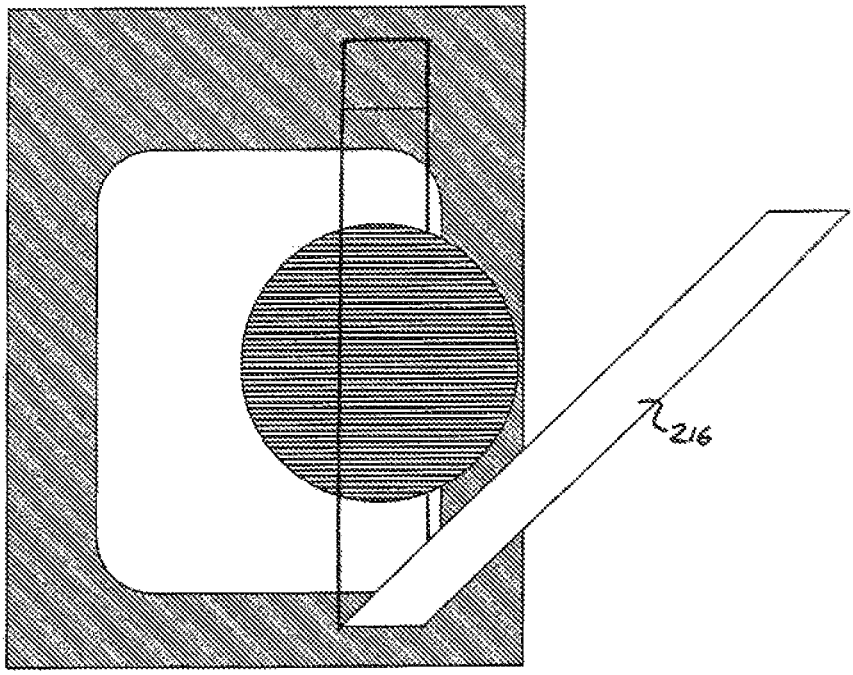
FIG. 8 shows a schematic view of the pouch of FIG. 7 which has been opened.

As shown in FIG. 8, the opened pouch 301 does not include an aperture 32 passing through the pouch, as no part of the second wall 8 has been removed as part of the tab portion 318.

It should be noted that in the embodiments shown in FIGS. 1,2,5,6,7 and 8 the tear strip can be any suitable width. It is preferably located towards one edge of the product portion so that the product may be easily accessed. The tear strip may be wide enough to encompass substantially all of product portion, similar to the embodiment in FIGS. 3 and 4 as this can provide an alternative access to the product.

Figure 9:
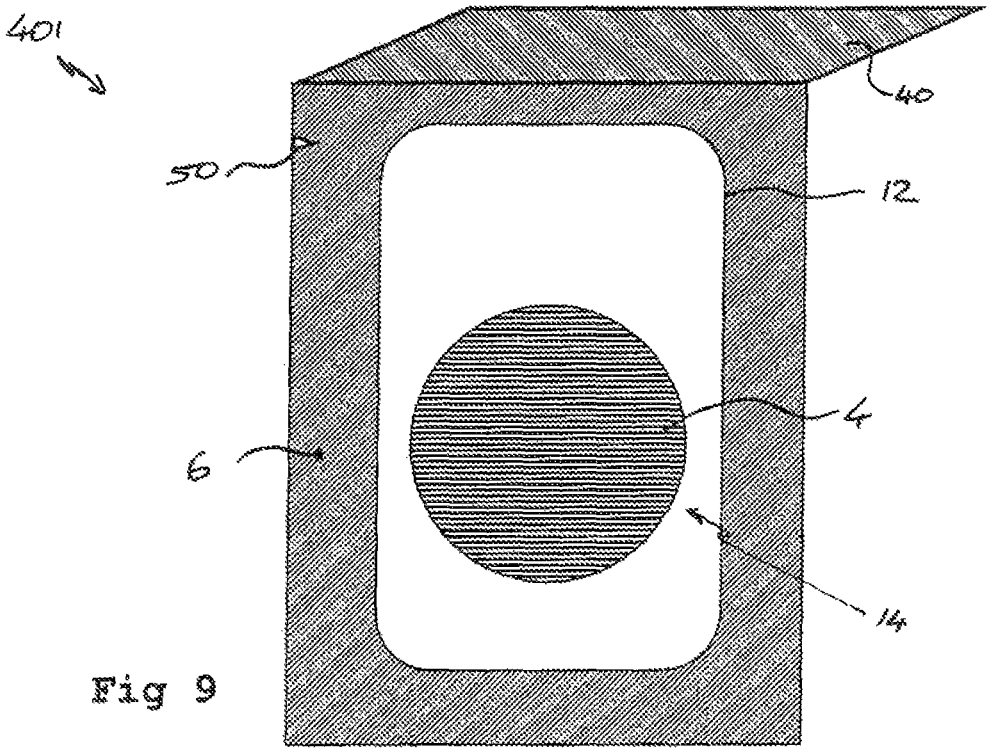
FIG. 9 shows a schematic view of a pouch in which a folded portion has been opened to reveal a tear notch.

FIG. 9 shows a schematic view of a pouch 401 in which a flap 40 has been opened to reveal a pre-formed weakness, in this case a mechanically or laser cut tear notch 50.

The flap 40 is substantially as described above and was initially peelably sealed to the first wall 6 and substantially hindered access to the tear notch 50. In this case the flap comprises portions of both the first and second walls 6,8. With the flap 40 unpeeled from the first wall 6 and folded away from the pouch the tear notch 50 is readily accessible and a user may readily initiate a tear from the tear notch 50 which extends across at least a portion of the compartment 12 so that a user gains access to the content of said compartment 12.

The tear notch 50 is located such that a tear initiated therefrom extends through the compartment 12, but avoids the product portion 14 to avoid damage to a product 4 therein.

Figure 10:
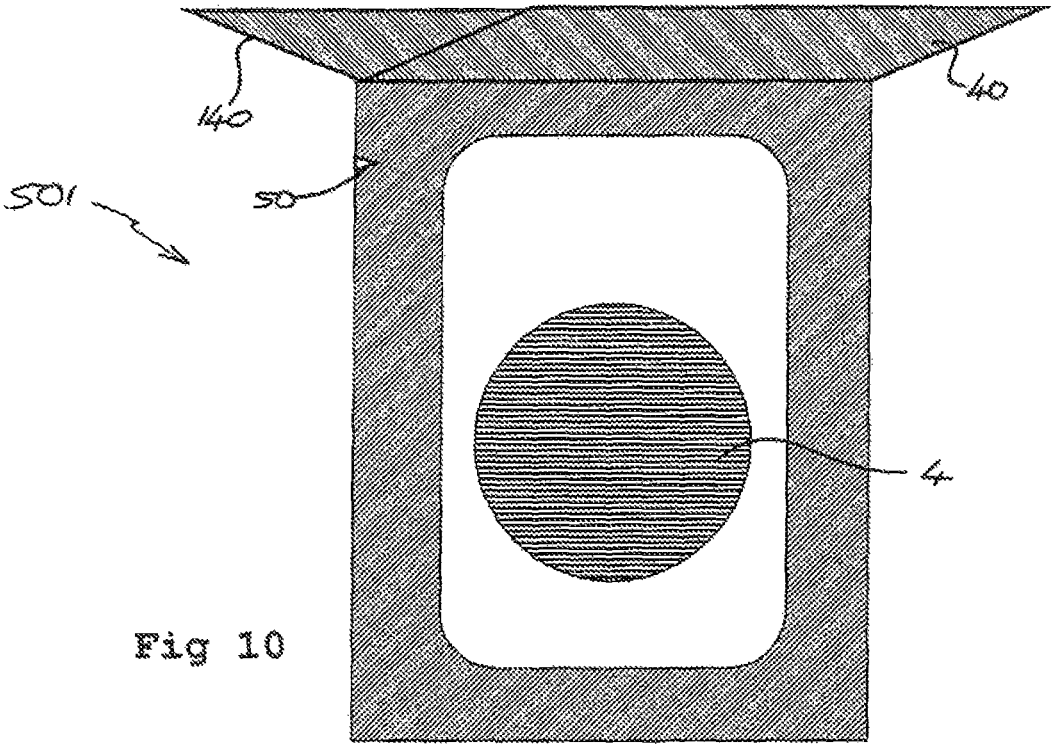
FIG. 10 shows a schematic view of a pouch in which two folded portions have been opened to reveal a tear notch.

FIG. 10 shows a schematic view of a pouch 501 in which two flaps 40,140 have been opened to reveal a tear notch 50. This embodiment is very similar to that shown in FIG. 9, except that two flaps 40,140 are present.

Flap 40 comprises a portion of the first wall 6 and was initially peelably sealed to the first wall 6, while folded portion 140 comprises a portion of the second wall 8 and was initially peelably sealed to the first wall 8.

In this embodiment both flaps 40,140 need to be unfolded in order to obtain unhindered access to the pre-formed weakness, which, in this case, is a tear notch 50.

It should be noted that the addition of a flap 40 is applicable to any embodiment in which a flap could substantially binder access to a tab portion, or any pre-formed weakness. In particular the use of a flap could be employed in the embodiment shown in FIGS. 3 and 4.

It should be understood that the invention has been described above by way of example only and that modifications in detail can be made without departing from the scope of the claims.

The invention claimed is:

1. A pouch for containing a product, the pouch comprising a first wall and a second wall, the first wall and second wall being joined together in sealed regions, the sealed regions substantially surrounding a partially separable compartment including a product portion within which a product can be located, the first wall comprising a tear strip extending across at least a part of the partially separable compartment, the tear strip including a tab portion at a proximal end, the tab portion being located away from the edges of the pouch and there being a sealed portion between the tab portion and the partially separable compartment, the tear strip including tear guiding regions in the first and second walls at first and second opposing edges, the pouch being arranged such that the tab portion can be grasped and a removal force exerted thereon to cause a tear to extend along each of the tear guiding regions and across at least a part of the partially separable compartment so that at least a portion of the tear strip is torn away from the pouch, wherein the at least a portion of the tear strip torn away from the pouch includes the product portion of the partially separable compartment and wherein the product is removable from either side of the tear strip.

2. A pouch as claimed in claim 1, in which the first wall is cut along a portion of the periphery of the tab portion of the tear strip and the tab portion is restrained to the first wall by at least one breakable bridge which can be broken to facilitate access to the tab portion.

3. A pouch as claimed in claim 1, in which the tear strip includes a portion of the second wall aligned with the tear strip of the first wall.

4. A pouch as claimed in claim 1, in which the pouch contains a medicament product in the product portion.

5. A pouch as claimed in claim 4 in which the medicament product comprises a patch.

6. A pouch for containing a product, the pouch comprising a first wall and a second wall, the first wall and second wall being joined together in sealed regions, the sealed regions substantially surrounding a compartment including a product portion within which a product can be located, the first wall comprising a tear strip extending across at least a part of the compartment, the tear strip including a tab portion at a proximal end, the tab portion being located away from the edges of the pouch and there being a sealed portion between the tab portion and the compartment, the tear strip including tear guiding regions in the first and second walls at first and second opposing edges, the pouch being arranged such that the tab portion can be grasped and a removal force exerted thereon to cause a tear to extend along each of the tear guiding regions and across at least part of the compartment so that at least a portion of the tear strip is torn away from the pouch, the portion of the tear strip torn away from the pouch including the product portion of the compartment, in which the pouch further includes a flap formed along one edge thereof, the flap formed by folding a portion of the pouch and releasably securing it to the first wall such that the flap substantially covers the tab portion.

7. A pouch as claimed in claim 6 wherein the pouch comprises two flaps, wherein each flap is releasably secured to an opposite side of the pouch.

8. A pouch as claimed in claim 6 wherein the releasable securing of the flap comprises a peelable seal.

9. A pouch as claimed in claim 6 in which each flap is formed from a separate piece of material.

10. A pouch for containing a product, the pouch comprising a first wall and a second wall, the first wall and second wall being sealed together in sealed regions, the sealed regions substantially surrounding a compartment including a product portion within which a product can be located, the pouch including at least one preformed weakness from which a user can initiate a tear and thereby gain access to the product portion of the compartment, the pouch further including at least two flaps, wherein each flap is formed by folding a wall portion of one of the first and second walls, each said wall portion being releasably secured to one side of the pouch such that each flap is releasably secured to an opposite side of the pouch.

11. A pouch as claimed in claim 10 in which each flap is releasably secured to a wall by peelably sealing the flap thereto.

12. A pouch as claimed in claim 10, in which the flap is formed from a separate piece of material.

* * * * *